United States Patent [19]

Zagar et al.

[11] Patent Number: 4,634,344

[45] Date of Patent: Jan. 6, 1987

[54] MULTI-ELEMENT CENTRIFUGAL PUMP IMPELLERS WITH PROTECTIVE COVERING AGAINST CORROSION AND/OR ABRASION

[75] Inventors: Irvin F. Zagar, Denver; Henry T. Choquette, Wheatridge, both of Colo.

[73] Assignee: A. R. Wilfley and Sons, Inc., Denver, Colo.

[21] Appl. No.: 637,572

[22] Filed: Aug. 3, 1984

[51] Int. Cl.[4] ..... F04D 1/04

[52] U.S. Cl. ..... 416/175; 415/170 B; 415/213 B; 416/186 R

[58] Field of Search ..... 416/175 R, 175 A, 179, 416/174, 183, 188, 186 R; 415/170 B, 213 B, DIG. 3, 213 R, 215

[56] References Cited

U.S. PATENT DOCUMENTS

| | | | |
|---|---|---|---|
| 509,321 | 11/1893 | Marsden | 416/91 |
| 1,175,162 | 3/1916 | McMurdie | 416/186 R |
| 2,220,669 | 11/1940 | Allen | 416/186 R |
| 2,429,978 | 11/1947 | Blanchard | 103/5 |
| 2,625,884 | 1/1953 | Welsh | 416/186 R |
| 2,780,176 | 2/1957 | Holzwarth | 416/186 R |
| 3,478,691 | 11/1969 | Henry IV | 416/183 |
| 3,494,292 | 2/1970 | Walker et al. | 103/114 |
| 3,893,817 | 7/1975 | Hackbarth et al. | 416/183 |
| 3,936,240 | 2/1976 | Dochterman | 416/175 |
| 3,944,406 | 3/1976 | Jagusch et al. | 416/186 R |
| 4,036,584 | 7/1977 | Glass | 415/90 |
| 4,236,871 | 12/1980 | Hirst et al. | 416/186 R |
| 4,255,081 | 3/1981 | Oklejas | 415/90 |
| 4,322,200 | 3/1982 | Stiegelmeier | 416/188 |
| 4,419,058 | 12/1983 | Franklin, Jr. et al. | 403/14 |

FOREIGN PATENT DOCUMENTS

| | | | |
|---|---|---|---|
| 497557 | 5/1930 | Fed. Rep. of Germany | 416/186 R |
| 2822499 | 11/1978 | Fed. Rep. of Germany | 415/213 B |
| 26849 | 10/1954 | Finland | 415/170 B |
| 55-32955 | 3/1980 | Japan | 416/186 R |
| 619374 | 3/1949 | United Kingdom | 416/186 R |

*Primary Examiner*—Everette A. Powell, Jr.

*Attorney, Agent, or Firm*—Shoemaker and Mattare, Ltd.

[57] ABSTRACT

A pump of centrifugal type having both an impeller unit and an expeller unit coupled together for effecting frictionless hydraulic seal during operation within an appropriate housing therefor. By providing an expeller unit separate from the impeller unit, the portions of the impeller unit which wear fastest can be replaced as needed without the need for replacing other components as soon. This greatly reduces the cost of maintenance and replacement. Also, rotor vanes and stacked separator discs in a preferred embodiment provide for greatly reduced manufacturing and assembly costs, and yet allow the flexibility of easy replacement of only parts that are severely worn or corroded as needed. Both the method of making and the method of assembly are encompassed by this invention.

Furthermore, all of the component elements are preferably rubber covered for maximum protection against abrasion and corrosive action of the liquid being pumped.

8 Claims, 13 Drawing Figures

MULTI-ELEMENT CENTRIFUGAL PUMP IMPELLERS WITH PROTECTIVE COVERING AGAINST CORROSION AND/OR ABRASION

BACKGROUND OF THE INVENTION

1. Field of the Invention

This invention relates generally to pumps for pumping liquids under high head pressure, and especially liquids which are corrosive and/or abrasive in nature.

2. Description of the Prior Art

A common problem with pumps of conventional design is that they do not pump under as high a head pressure as desired, or they are unduly complicated and/or costly, and also are subject to deterioration and wear when pumping abrasive and/or corrosive liquids. Pumps have been designed and made to overcome some of these problems; however, to date none of the known devices have satisfactorily solved all of these problems.

There have been pumps designed of multi-element construction for the purpose of simplifying the producing and assembly of pumps at lower cost, but again, the known designs fail to meet all of the needed requirements of the art.

Existing prior art patents which may be pertinent to the present invention are as follows:

U.S. Pat. No. 4,255,081—3/10/81
U.S. Pat. No. 4,036,584—7/19/77
U.S. Pat. No. 3,494,292—2/10/70
U.S. Pat. No. 2,429,978—11/ 4/47
U.S. Pat. No. 509,321—11/21/1893

U.S. Pat. No. 509,321 discloses a suction blower having structure and assembly techniques somewhat related to the present invention.

U.S. Pat. No. 2,429,978 discloses a plurality of curved vanes which are mounted in separate sections, with the sections being held together by bolts; however, again, this device is quite different from that of the present invention.

None of the known prior art devices offer the new and novel features of the present invention.

SUMMARY OF THE INVENTION

An object of the present invention is to provide a multi-element pump impeller including both an impeller unit and an expeller unit, which are connected together to function as one integral pump structure.

Normally, conventional type impeller structures are relatively complex and quite difficult in both pattern making and in casting of the structure. However, the present invention separates the component units of the impeller, which greatly simplifies the foregoing steps. The present design offers the great advantage of being able to use investment casting for the pumping vanes and also the expeller vanes when desired, thus obtaining much higher quality castings and much smoother surfaces both internally and externally. This offers the desirable benefit of higher pressures and greatly improved efficiency. Another important advantage is in the increased ease of castability and/or use of fabricated materials for the overall impeller structure.

A further object of this invention is to provide an impeller structure which uses a common expeller, but provides for different impeller units of various multi-element construction. This offers a great advantage of being able to use a simplified common expeller for all pumps, and yet enable the use of various type impeller units with various type multi-element components for increased ease of manufacture and reduction of costs.

A still further object of the present invention is to reduce the deterioration and corrosive effects when pumping liquids of a corrosive nature. By covering the impeller structure with rubber, including the assembly bolts and/or screws, the entire impeller can be made so that it is very resistant to any corrosive liquid or abrasive materials.

During the pumping of chemicals and abrasive solids in suspension, there is a great tendency to wear the pumping vanes in the impeller unit, with very little wear, however, to the vanes of the expeller. By having a two or more part impeller structure, that is, an expeller which is separate from the impeller pumping structure, it is very easy to replace just the one impeller unit and continue to use the same basic expeller unit. This, again, can result in substantial cost savings to the user and reduce the requirements for purchase of replacement parts for the pump. With the multi-element design of the present invention, of course, just the pumping vanes, which wear the most, can oftentimes restore the impeller unit to its original efficiency.

Also, the present invention for impeller structure permits, by the use of the component elements disclosed, the advantage of giving an end user dual units or even multiple units which will result in an increase in intake flow and head holding ability. Furthermore, this design allows for the advantage of being able to produce both impellers and expellers of different materials, or materials which previously could not be used because of the complexity of the double vaned centrifugal pump of conventional construction.

In the present invention the impeller and expeller units, when assembled as an integral centrifugal pump impeller, are held in position by the compressive force generated by the complementary drive shaft and impeller projection internal threads. Thus, no press fitting and/or welding, or any other type of fastening structure, is needed for the impeller and expeller to rotate in combination. The forces of the hydraulic liquid being pumped on the impeller pumping vanes continually keep the assembly tight in the present invention.

In addition, in the present invention the impeller design having a multi-element separator disc and impeller vanes permits the use of prefabricated parts instead of cast parts, with many resultant advantages. The component elements in this design can be assembled from parts that are produced from blanking dies and plate stock. This method eliminates the need for impeller castings, which, of course, are the greater part of the cost in impeller manufacturing. Production parts for the various multi-elements can be all produced from plate stock on a production line using a punch die. The resultant cost saving can vary from 25% to 60% of the cost of conventional type casting designs.

Another still further object is to produce a centrifugal pump having more efficient operating curves. As disclosed herein, the multi-element impellers of the present invention have increased overall operation efficiency over conventional type pumps.

A still additional object of the present invention is to provide for an impeller structure which is resistant to deterioration from abrasive or corrosive type materials being pumped. Completely covering the impeller elements with rubber and then covering any assembly bolts with rubber and vulcanizing all together for complete separation of the metal component elements from the liquid being pumped is an important improvement of the present invention. Of course, making the entire structure of rubber would answer the purpose; however, to do so requires compression molding, which requires a compression mold, and in today's economy, the cost of such molds is entirely prohibitive. However, the use of rubber as a protective material is still highly desirable. Therefore, the present invention achieves the desirable benefits of using rubber coating for protection, at a greatly reduced amount of cost. All of the multi-element structures disclosed in this application can be so protectively coated.

The present invention offers a number of new, novel, and important advantages over conventional type structures.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT(S)

Figure 1:
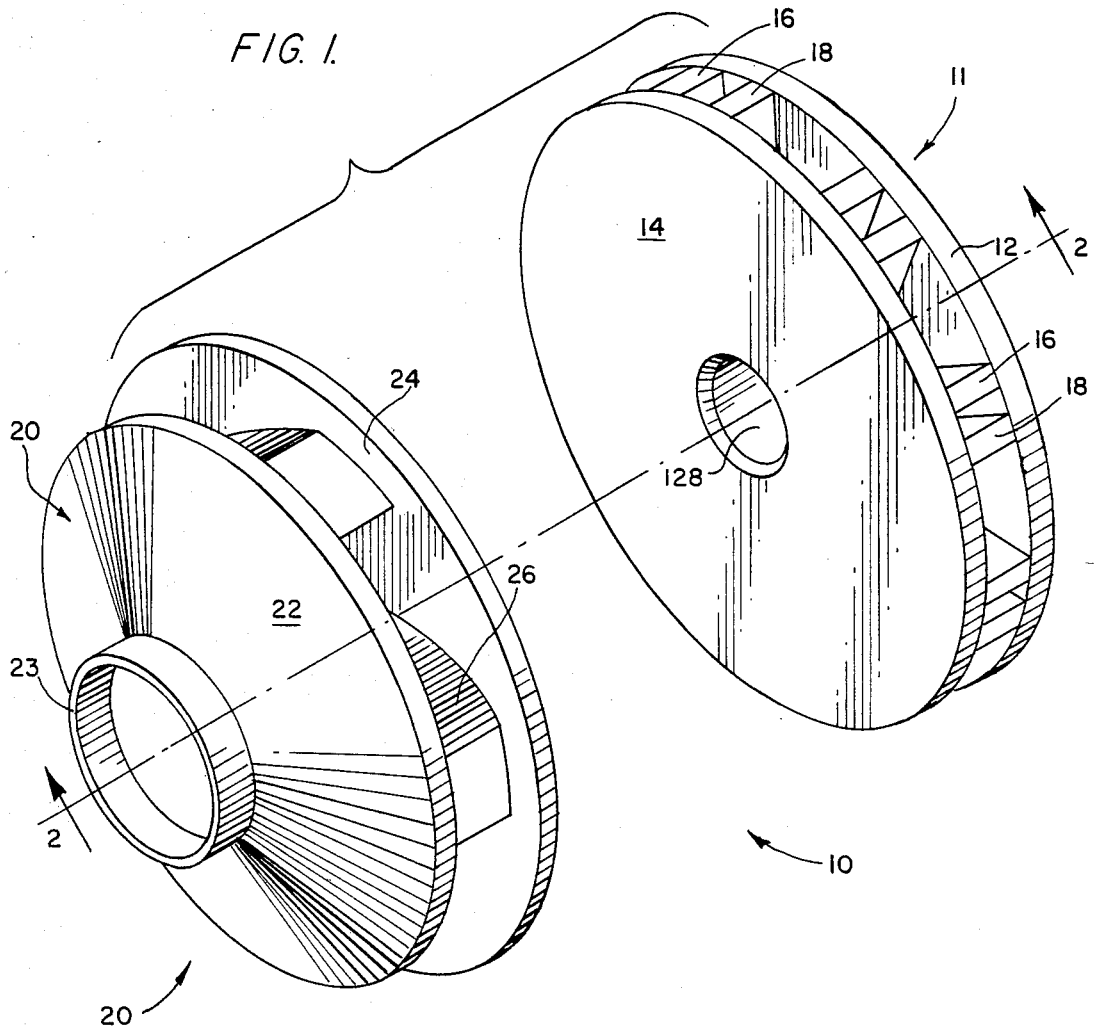
FIG. 1 is an exploded perspective of the two-part impeller device of the present invention.

Referring to FIG. 1 of the drawings, reference numeral 10 indicates in general the pump structure of the present invention. An expeller unit 11 and an impeller unit 20 are shown. In this first embodiment, the two units are each integral and entirely self-contained. However, in the embodiments disclosed hereafter, these units may be made of multi-elements and fabricated and assembled in a manner to be described subsequently. However, in this first embodiment, each component unit is preferably cast, even though different types of casting procedures may be used for the different respective units.

Figure 2:
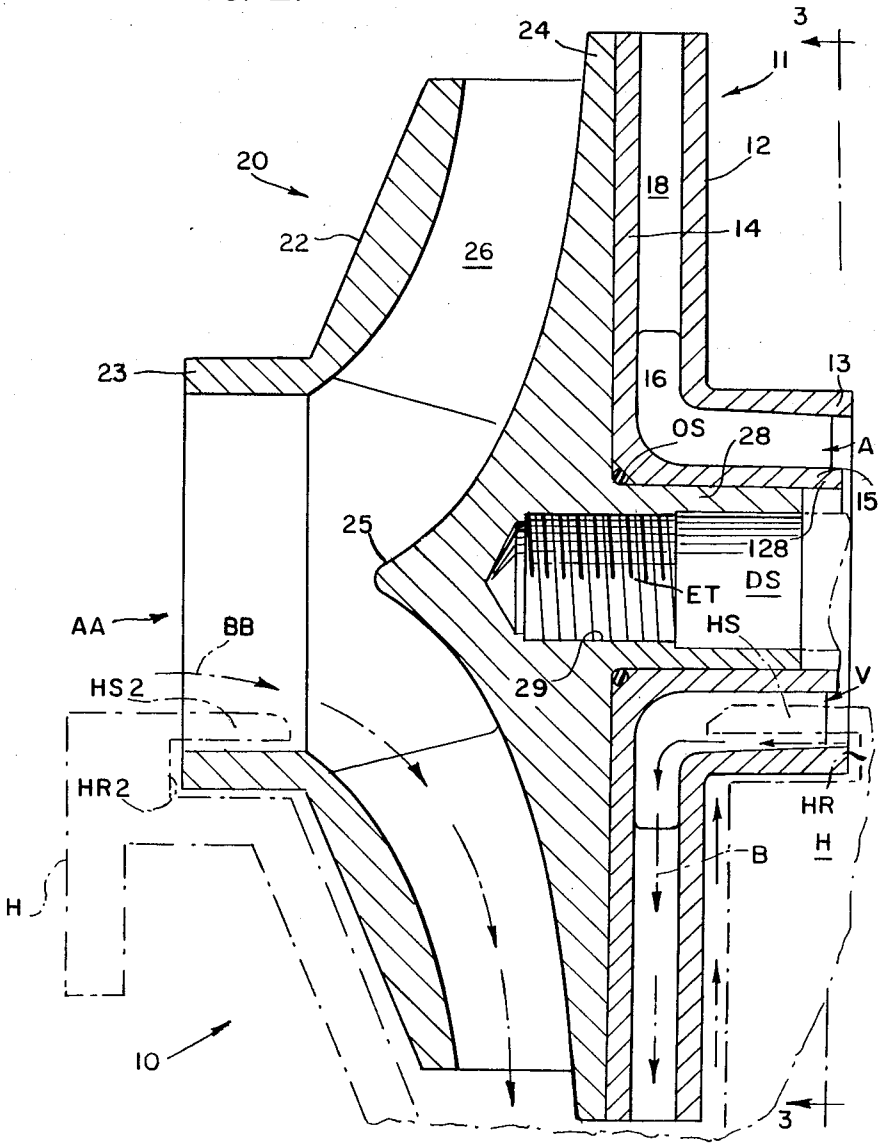
FIG. 2 is a side elevational view, partly in cross section, taken, generally along line 2—2 of FIG. 1.
Figure 3:
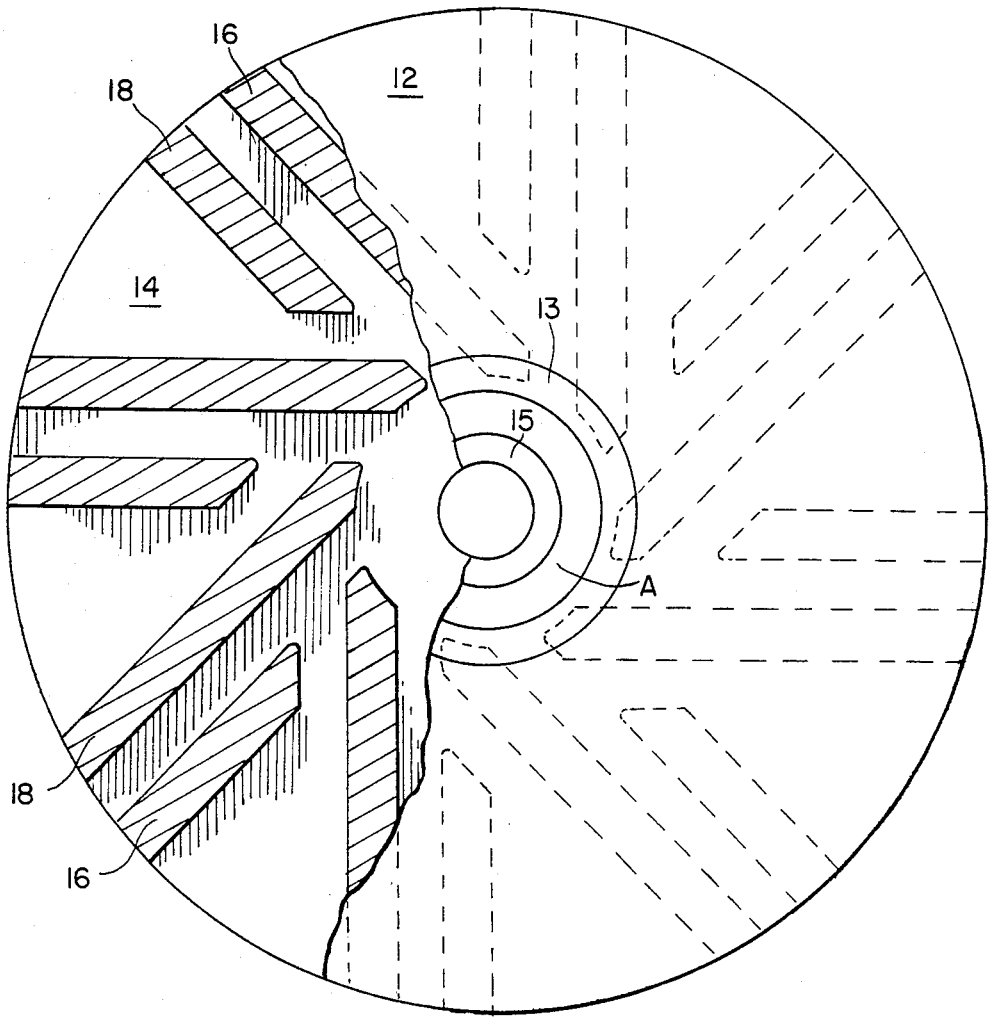
FIG. 3 is an elevational view of the expeller unit looking in the direction of arrows 3 in FIG. 2.

FIG. 2 shows in side elevation the impeller and expeller units as assembled, while FIG. 3 shows in end elevation, partly in cross-section, an expeller unit per se. As best seen in FIG. 2, the expeller unit 11 has a pair of walls 12 and 14 which are parallel to each other, and contain therebetween vane structure 16 and 18. The wall 12 has an axial hub extension 13 and the wall 14 has an axial hub extension 15. The space between these axial hub extensions permits a hydraulic liquid flow inwardly as indicated by arrow A. Normally, a projection HS on the housing H extends into the space between these axial hub extensions. This projection HS, together with the recess HR, as best seen in FIG. 2, provide the seal structure which is frictionless and eliminates the use of any packing, water glands or conventional type mechanical seals. Thus, to prevent leakage while running, this design of the expeller unit creates a hydraulic seal. As can be seen by the flow indicated by the arrows B, the expeller unit effects liquid flow inwardly through the housing and outwardly of the expeller so as to create a vacuum or void V at the area closest to the pump shaft DS. This elimination of any friction type seal structure increases the overall pump efficiency and likewise substantially reduces maintenance costs for replacement of conventional type seal structure.

The impeller unit 20 has a front wall structure 22, a rear wall structure 24, and vanes 26 integrally formed therebetween. An input flow diverter point 25 is also integral with rear wall 24. Also provided within the hub area of the rear wall 24 is a pump drive shaft hole 29 provided with internal threads IT. These internal threads IT mate and complement with external threads ET on the end of drive shaft DS. Thus, the hub projection 28 when inserted into the central opening 128 of the expeller unit 11, together with the 0-ring seal OS, effectively couples the two units drivingly together and also forms a leakproof seal therebetween.

An axial hub projection 23 is provided in the center of front wall 22 of the impeller. This provides an opening AA for liquid flow (arrows BB) thereinto. Again, the housing H has a housing seal projection HS2 provided therewith and a sealing recess HR2. Again, this structure mating with the hub projection 23 effects a restricted flow path and minimizes recirculation of the fluid. The flow of hydraulic fluid being pumped, either containing abrasive materials and/or corrosive chemicals or materials, is effected as indicated by arrows BB.

Figure 4:
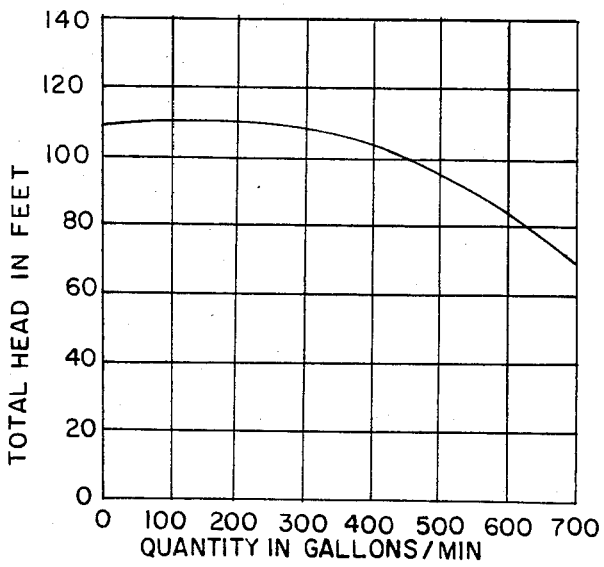
FIG. 4 is a graph depicting the improved results of the two-part pump embodiment of FIGS. 1–3.

Because of the forming of the impeller unit 20 separate from the expeller unit 11, it is possible to cast same with greater precision and of higher quality material than previously, and, therefore, the overall efficiency of this impeller unit can be substantially increased, as depicted by the graph curve of FIG. 4. This graph shows actual test results achieved by this unit. As shown in the following table, the efficiency is quite good at an indicated operating speed of 1,770 rpm.

| TEST RESULTS - EMBODIMENT OF FIGS. 1-3 | | |
|---|---|---|
| 682.0 GPM | 601.0 GPM | 501.0 GPM |
| 73.3 TDH | 84.0 TDH | 93.1 TDH |
| 22.3 BHP | 20.7 BHP | 19.6 BHP |
| 56.5 EFF | 61.5 EFF | 60.0 EFF |

The efficiency of over 60% for this unit is greatly improved over conventional type units.

Of course, while only a portion of the overall housing is depicted in the drawings, the entire housing structure as is conventional is provided in the actual unit.

Looking at FIGS. 5–8, the preferred embodiment of the present invention will now be described. This multi-element pump is best seen in the exploded perspective of FIG. 5, and comprises an expeller unit 11 similar to that already described, together with an impeller unit 30 of improved structure and construction. The multi-element impeller 30 has a front shroud plate 40 and a plurality of separator discs 41. Initially, each of these plates and discs are die punched from plate stock without any assembly holes therein. The plates also can be machined from plate stock if more accuracy is desired. A plurality of impeller vanes 50 are also die cut from plate stock, or cast if desired, and are appropriately spaced between the front shroud plate 40 and the desired number of separator discs 41. An impeller hub 34 having a mounting shaft 32 is also machined from bar stock. Similarly, an impeller seal hub 70 is cut from a pipe of approximately 4" in diameter and about 2½" in length. A flange 72 may be appropriately provided and attached to this short section of pipe, or appropriately machined thereon.

The next step in the assembly and construction of this preferred embodiment is to stack the expeller 11, the plurality of separator discs 41 with impeller vanes 50 appropriately spaced therebetween, and the shroud plate 40 one upon another in the desired assembled position. A plurality of holes are then drilled in the respective components for openings 42 and 43, which receive, respectively, the aligning dowels 46 and the assembly screws 44. The head 45 of each assembly screw is appropriately tapered and the front shroud plate 40 has the appropriate holes 43 therefor countersunk so that the outside surface of each screw will be flat and correspond to the front surface of plate 40.

Prior to assembly of the other components, the impeller hub 34 is welded W into place with mounting shaft 32 within the aperture 128 of expeller unit 11. Also, the impeller seal hub 70 is appropriately welded W to the front surface of shroud plate 40.

All of the component elements are then put together by placing the alignment dowels 46 through the appropriate holes 42, 52 in the respective plate and discs, and then attaching screws 44 appropriately applied through holes 43 and 53 of the respective units into tapped holes 63 of the expeller unit 11. After all of the component elements have been appropriately fastened in place by the screws 44, the entire assembled unit is then put in the chuck of an engine lathe, and all of the outside diameters are carefully machined to the desired outer dimensions. Thus, a completely assembled and finished unit is made.

Of course, in the field, as the vanes tend to wear or be eaten away by corrosive materials, the entire impeller unit can be quickly and easily disassembled for replacement of the vanes. Also, of course, if other of the component elements become grossly worn, they, likewise, can be easily replaced. However, in actual practice, the vanes are the elements which have to be replaced most often.

Figure 7:
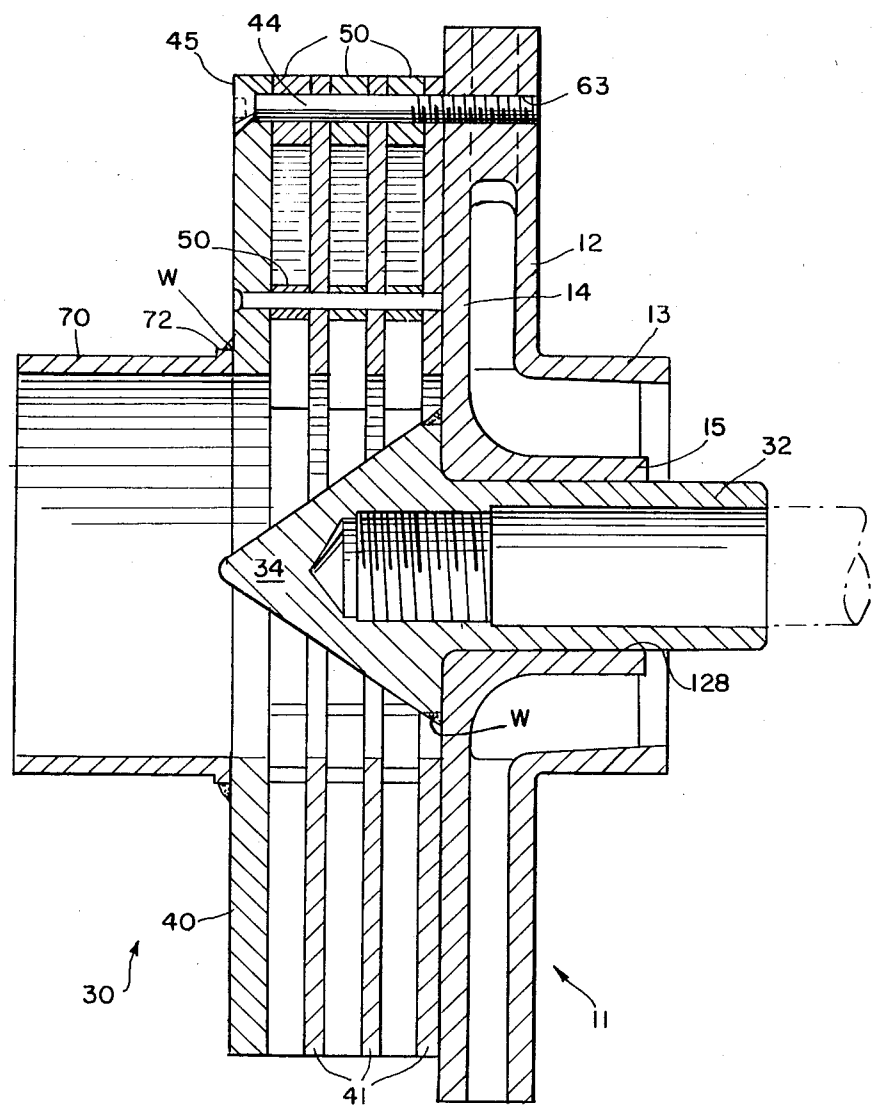
FIG. 7 is a side elevational view, partly in cross section, taken generally along line 7—7 of FIG. 6.
Figure 6:
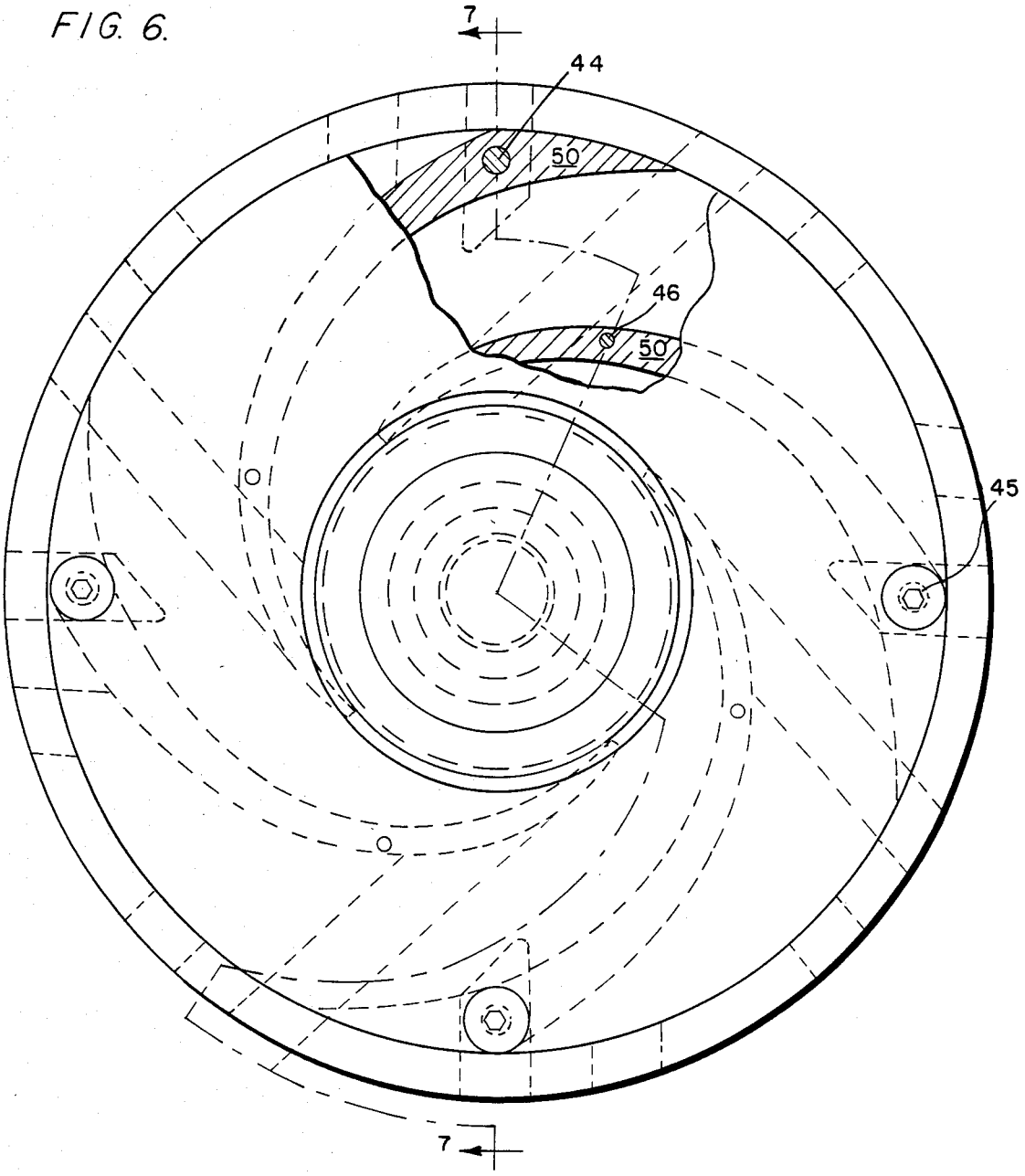
FIG. 6 is an end elevational view of the stacked component impeller unit of FIG. 5, partly in cross-section.

FIG. 6 shows in end elevation the stacked impeller of the preferred embodiment, while FIG. 7 shows in side elevation, partly in cross-section, the same structure. Components which are the same as those of the first embodiment are indicated by the same reference numerals.

Figure 8:
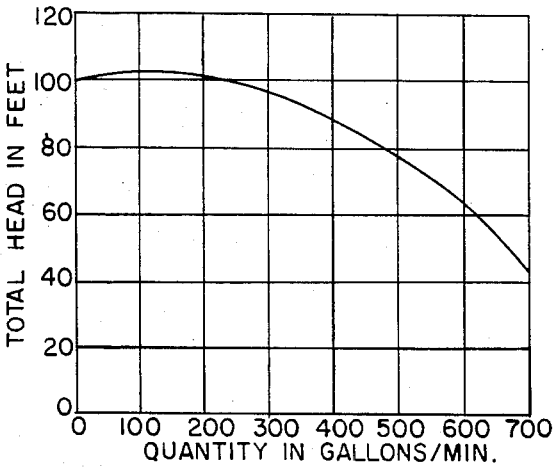
FIG. 8 is a graph showing the improved results of the stacked impeller embodiment of FIGS. 5–7.

FIG. 8 shows a graph of the improved results as effected by this preferred embodiment. At an operating speed of 1,770 rpm, the table below shows the improved efficiency achieved by this pump embodiment.

Figure 5:
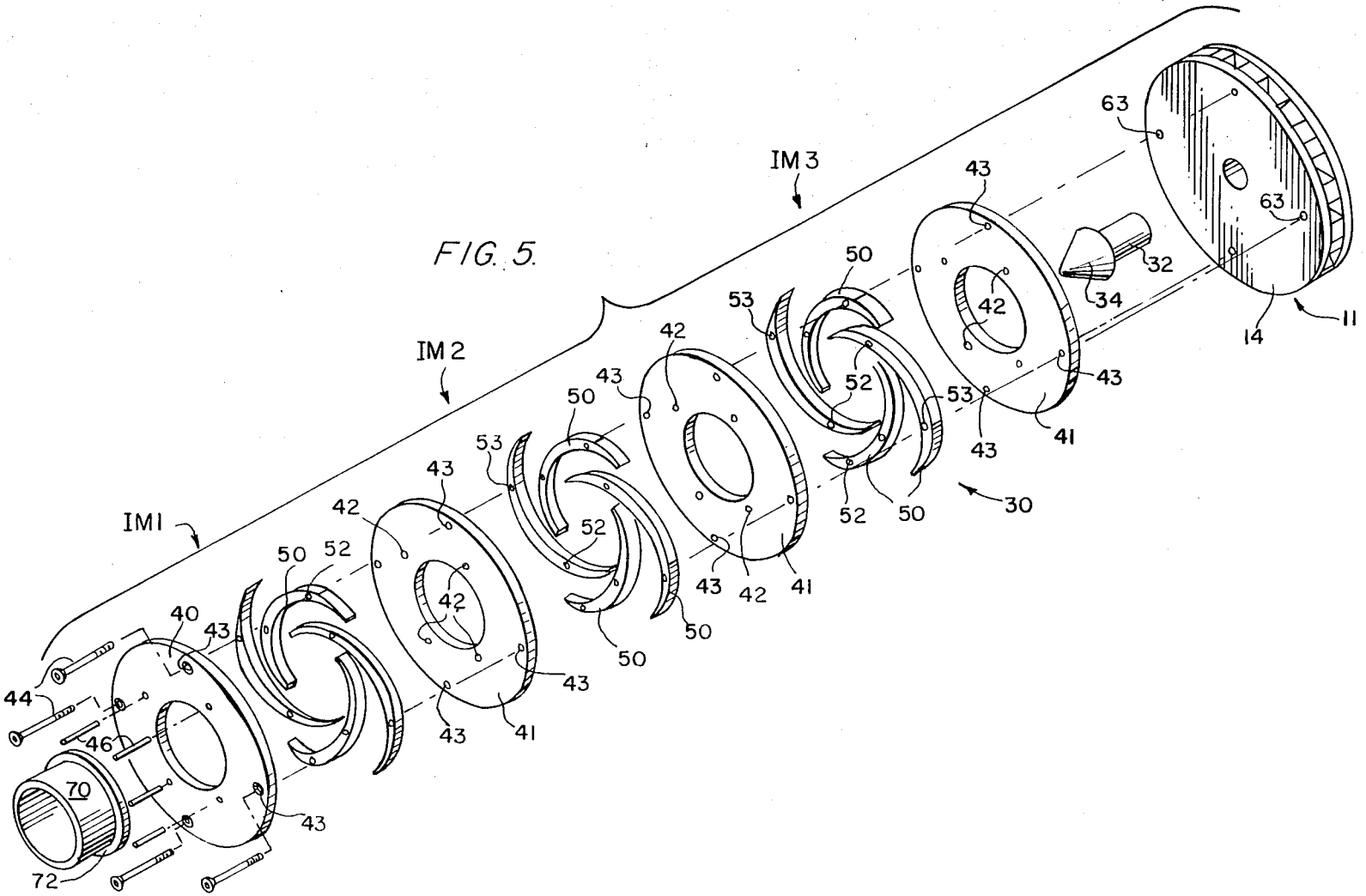
FIG. 5 is an exploded perspective view of the stacked component impeller/expeller embodiment of the present invention.

| TEST RESULTS - EMBODIMENT OF FIGS. 5–7 | | |
|---|---|---|
| 621.0 GPM | 517.0 GPM | 414.0 GPM |
| 67.1 TDH | 78.6 TDH | 88.5 TDH |
| 18.5 BHP | 17.2 BHP | 15.7 BHP |
| 57.0 EFF | 59.8 EFF | 59.0 EFF |

Figure 10:
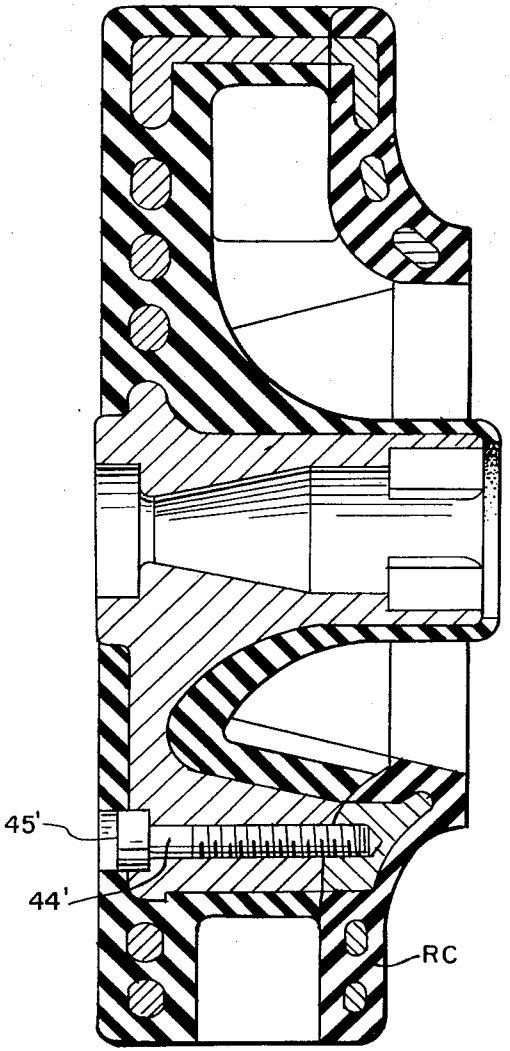
FIG. 10 is a side elevational view, partly in cross section, taken along line 10—10 of FIG. 9.
Figure 9:
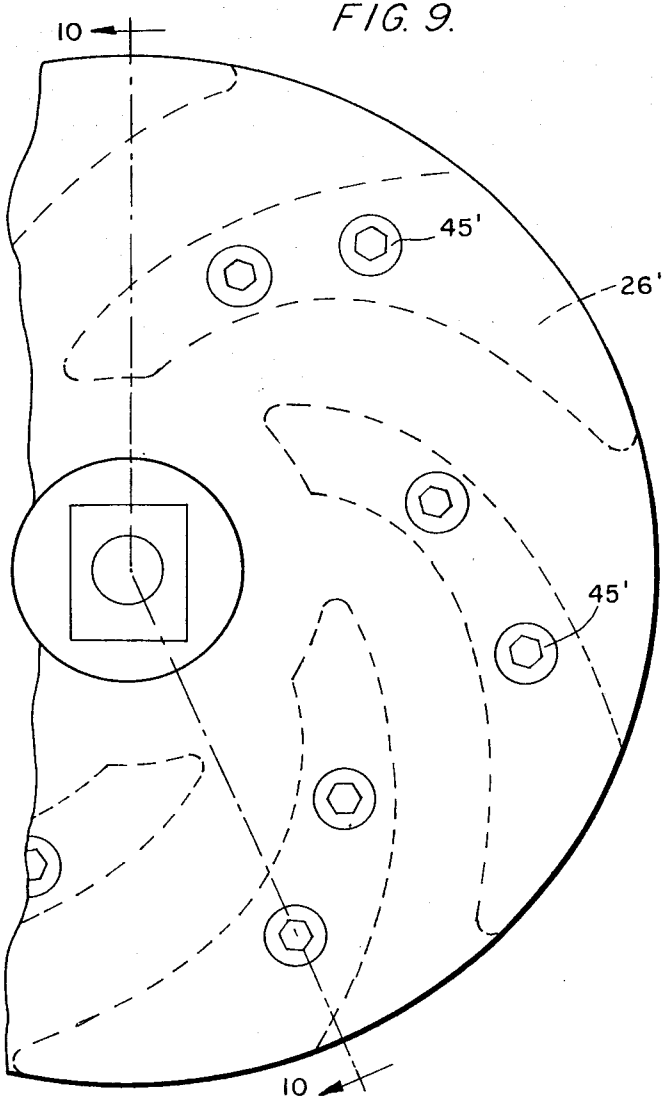
FIG. 9 is an end elevational view of a rubber covered impeller unit.
Figure 11:
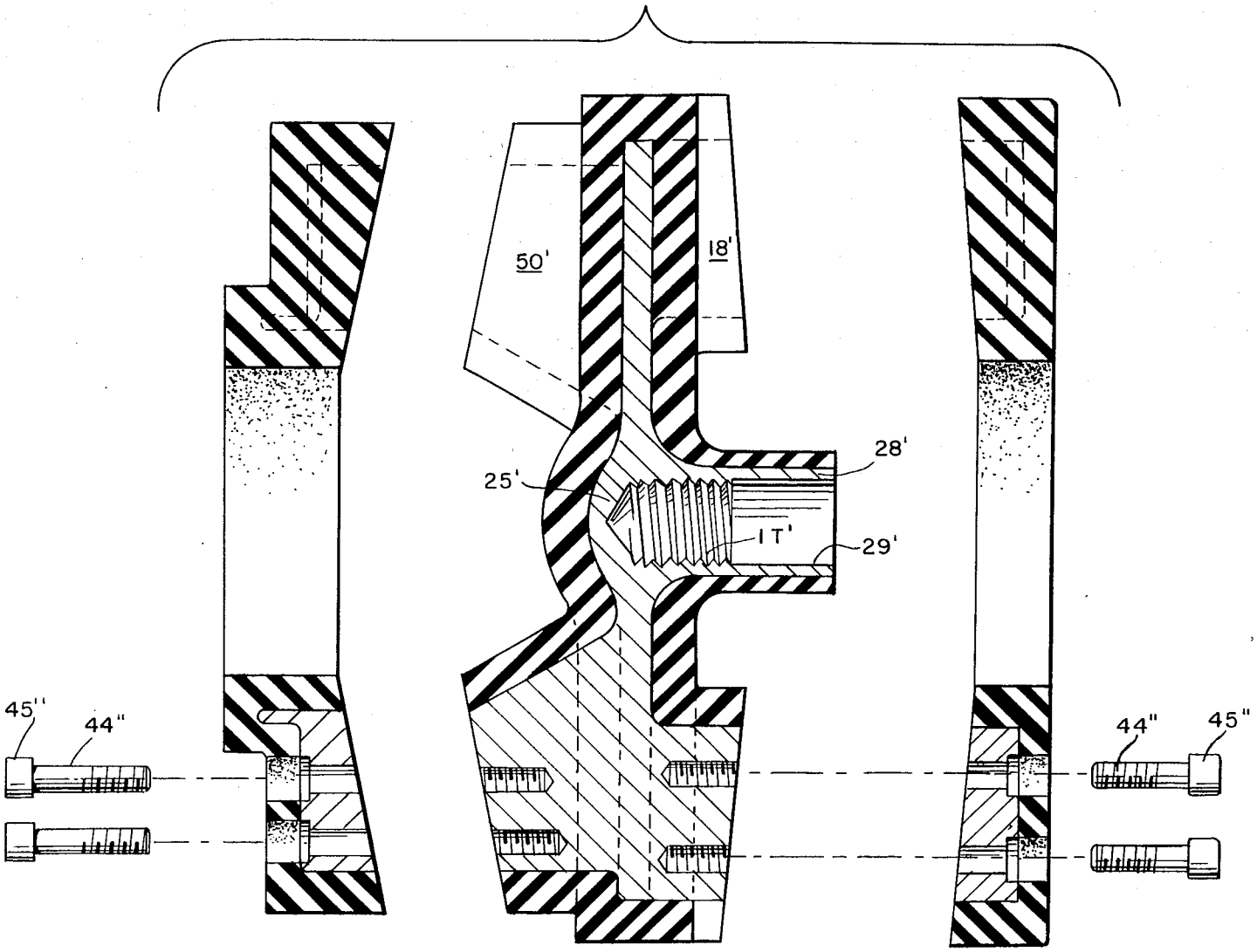
FIG. 11 is a partly exploded side elevational view, partly in cross section, of a three piece pump embodiment, which is protectively covered with rubber.

FIGS. 9 and 10 show respectively in end elevation and side cross-section an impeller unit of basically cast configuration having impeller vanes affixed by appropriate bolts and with all the component elements being rubber covered. This rubber covering RC protects the metal of the component elements from abrasive and corrosive effects of the liquid being pumped thereby. Preferably, all of the individual component elements are rubber coated prior to assembly, and then after assembly with the bolts, the exposed surfaces of the bolts are also rubber covered. Then, all the junction points between the rubber coverings are vulcanized to form an integral, watertight, leakproof protective seal over all the elements. Thus, of course, forming a completely rubber covered and protected pump structure.

Figure 13:
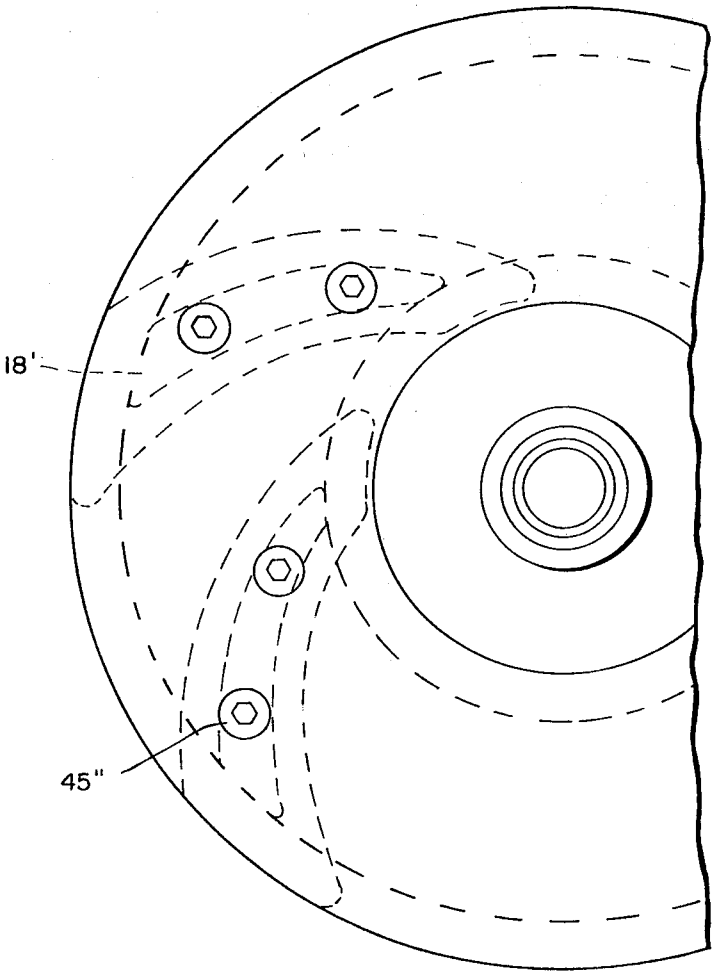
FIG. 13 is an end elevational view of the expeller unit of the embodiment of FIG. 11.
Figure 12:
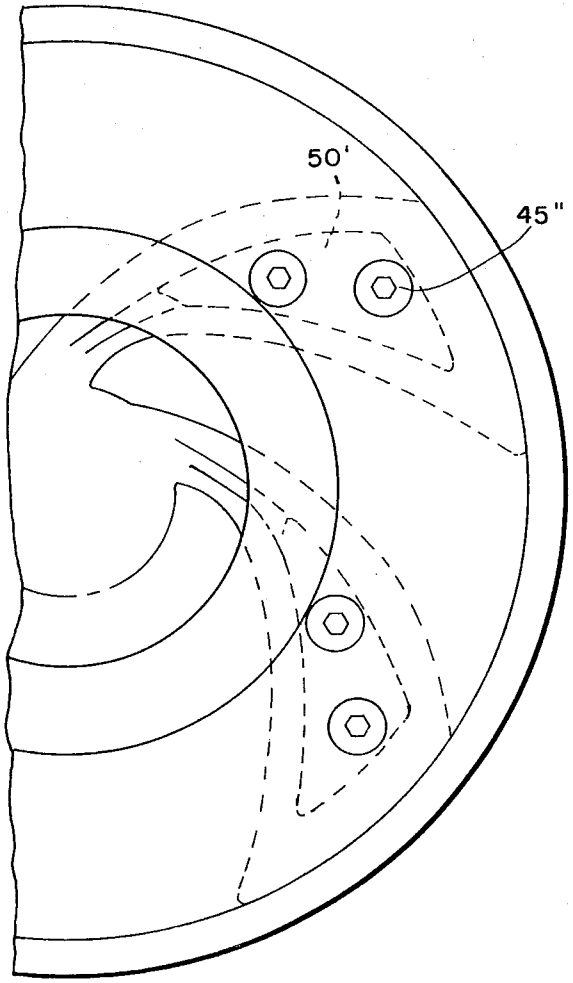
FIG. 12 is an end elevational view of the impeller unit of FIG. 11.

FIGS. 12–13 show another protective covered embodiment of the present invention. In this embodiment, a three-part structure is provided with the impeller and expeller units having a common middle portion therebetween. Again, the wall portions of these units can be formed by casting, while the impeller and expeller vanes can be die cut from appropriate plate stock, or also formed by castings. All of the individual components are again rubber covered RC, then assembled by the use of the appropriate bolts 44", then the exposed portions of the bolts are rubber covered and the entire covering is vulcanized for a liquid impervious protective coating.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

We claim:

1. A pump device comprising:

an impeller unit having substantially parallel front and back walls including;

a first plate having a central aperture therethrough, a plurality of separator discs also each having a central aperture therethrough, and a plurality of solid vanes with assembly holes therethrough;

an expeller unit having substantially parallel front and back walls with a plurality of solid vanes between said walls, a central input aperture leading to openings between said vanes and walls, and peripheral openings around the circumference of said expeller unit;

aligning and fastening means for aligning and holding the solid vanes, the first plate, the separator discs and the expeller unit together;

means for diverting liquid flowing inwardly through said central apertures outwardly to said vanes;

non-frictional seal means at the central aperture of said first plate;

said aligning and fastening means for aligning and holding the component elements together comprising a plurality of separate dowels and separate assembly screws;

said separate dowels fitting through inner circumferential holes in the solid vanes, the first plate, and the separator discs; and said separate assembly screws fitting through outer circumferential holes in the solid vanes, the first plate, and the separator discs, and being screwed into tapped holes of the expeller unit.

2. The pump device of claim 1, wherein said aligning and fastening means for aligning and holding the component elements together further includes said assembly screws having tapered heads thereon, and countersunk holes provided in said first plate for receiving said tapered heads and for presenting a flat overall surface for said first plate.

3. The pump device of claim 2, wherein said means for diverting incoming liquid flow outwardly includes a conical insert fixed to said expeller unit, said conical insert extending into the pump central area as defined by said apertures in the plurality of separator discs.

4. The pump device of claim 3, wherein said diverter means conical insert is affixed to said expeller unit by welding.

5. The pump device of claim 2, wherein said seal means at the input of said front plate includes a tubular portion having a longitudinal opening therethrough and a retaining flange at one end thereof.

6. The pump device of claim 5, wherein said seal means is affixed to said front plate by welding.

7. The pump device of claim 1, wherein said means for diverting incoming liquid flow outwardly includes a conical insert fixed to said expeller unit which extends into the central area as defined by said apertures in the plurality of separator discs.

8. The pump device of claim 1, wherein said seal means at the central aperature of said first plate includes a tubular portion having a longitudinal opening therethrough and a retaining flange at one end thereof.

* * * * *